US005634219A

United States Patent [19]

Paredes et al.

[11] Patent Number: 5,634,219

[45] Date of Patent: Jun. 3, 1997

[54] SHOWER DOOR ASSEMBLY

[75] Inventors: Raul M. Paredes, Barrington; Frank T. Poggio, Rolling Meadows; Bruce M. Sauter, Elgin; Dana F. Buccicone, Crystal Lake, all of Ill.

[73] Assignee: Sterling Plumbing Group, Inc., Rolling Meadows, Ill.

[21] Appl. No.: 424,858

[22] Filed: Apr. 19, 1995

[51] Int. Cl.[6] ..... A47K 3/22

[52] U.S. Cl. ..... 4/558; 4/608; 4/610; 160/369; 160/378; 160/DIG. 8

[58] Field of Search ..... 4/557, 558, 600, 4/607, 608, 610; 160/210, 329, 369, 371, 378, DIG. 8

[56] References Cited

U.S. PATENT DOCUMENTS

| | | | |
|---|---|---|---|
| 3,025,532 | 3/1962 | Skuda | 4/608 |
| 3,054,118 | 9/1962 | Bullock | 4/607 |
| 3,188,699 | 6/1965 | Walters | 4/607 X |
| 3,293,664 | 12/1966 | Coons | 4/599 |
| 3,940,806 | 3/1976 | Mustee | 4/614 |
| 4,539,721 | 9/1985 | Moore | 4/613 |
| 4,545,083 | 10/1985 | Searson | 4/615 |
| 4,569,092 | 2/1986 | Baus | 4/596 |
| 4,598,433 | 7/1986 | Whitney | 4/607 |
| 4,606,084 | 8/1986 | Baus | 4/607 |
| 4,720,876 | 1/1988 | Tomei et al. | 4/614 |
| 4,856,126 | 8/1989 | Baus | 4/607 |
| 4,882,795 | 11/1989 | Baus | 4/607 |
| 4,896,458 | 1/1990 | McKann et al. | 99/501 |
| 4,897,889 | 2/1990 | Baus | 4/607 |
| 4,914,770 | 4/1990 | Baus | 4/612 |
| 4,953,261 | 9/1990 | Lyons | 16/354 |
| 4,989,279 | 2/1991 | Powell | 4/612 |
| 5,023,965 | 6/1991 | Reichel | 4/607 |
| 5,070,549 | 12/1991 | Campe | 4/596 |
| 5,083,330 | 1/1992 | Dusar | 4/610 |
| 5,097,543 | 3/1992 | Oille | 4/607 |
| 5,123,129 | 6/1992 | Lyons | 4/557 |
| 5,337,424 | 8/1994 | Strack et al. | 4/557 |

FOREIGN PATENT DOCUMENTS

| | | | |
|---|---|---|---|
| 0118883 | 9/1984 | European Pat. Off. . | |
| 0389000 | 9/1990 | European Pat. Off. | 4/610 |
| 2502678 | 10/1982 | France . | |
| 2683441 | 5/1993 | France | 4/610 |
| 3326790 | 2/1984 | Germany | 4/607 |
| 3831521 | 3/1990 | Germany | 4/610 |
| 0292836 | 8/1991 | Germany | 4/607 |
| 2213185 | 8/1989 | United Kingdom . | |
| 2264233 | 8/1993 | United Kingdom | 4/557 |
| 94/18878 | 9/1994 | WIPO . | |

OTHER PUBLICATIONS

Builders Square advertisement for "Lyon's Shower Veil Tub Door", Mar. 19–21, 1995 (2 pages).

*Primary Examiner*—Robert M. Fetsuga

*Attorney, Agent, or Firm*—Merchant, Gould, Smith, Edell, Welter & Schmidt, P.A.

[57] ABSTRACT

A lightweight, low cost shower door assembly for enclosing a tub or shower enclosure having sides and a base. It includes an upper support member adapted to be positioned against opposing sides of the enclosure and a lower support member adapted to be positioned against the base of the enclosure. A door in the assembly includes a flexible rod connecting first and second frame members. The first frame member is connected to the upper and lower support members and positioned for movement about a vertical axis. The flexible rod is bowed to apply an upward force on the second frame member in order to maintain it in releasable connection with the upper support member. In use, a section of replaceable fabric or vinyl extends across the frame members in order to provide a water barrier for the door.

18 Claims, 11 Drawing Sheets

SHOWER DOOR ASSEMBLY

FIELD OF THE INVENTION

This invention relates to a shower door and a method for installing a shower door.

BACKGROUND OF THE INVENTION

Shower doors are typically installed with a rigid safety glass or plexiglass material. These doors are heavy and expensive due to the glass materials. The weight of the glass materials makes it more difficult and expensive to move or transport the doors. Also, these doors usually require professional installation, since they are intended to be permanently mounted to a shower enclosure. The required installation thus also significantly increases the overall cost of the shower door. Accordingly, a need exists for an improved shower door and, more particularly, a low-cost, lightweight alternative to existing shower doors.

SUMMARY OF THE INVENTION

This invention is a shower door assembly for enclosing a tub or shower enclosure having sides and a base. It includes an upper support member adapted to be positioned against opposing sides of the enclosure and a lower support member adapted to be positioned against the base of the enclosure. A first frame member is connected to the upper support member and the lower support member and is positioned for movement about a vertical axis. A second frame member is adapted to be releasably connected to the upper support member. A brace member connects the first and second frame members in order to form a structure for the door, and the brace member is adapted to apply an upward force on the second frame member in order to maintain a releasable connection with the upper support member. In use, a section of fabric extends across the frame members in order to provide a water barrier for the door.

This invention is also a method of installing a shower door assembly for enclosing a tub or shower enclosure having sides and a base. The method includes the following steps. An upper support member is installed and positioned against opposing sides of the enclosure, and a lower support member is installed and positioned against the base of the enclosure. A sealing member is installed against one of the sides of the enclosure. A first end of a first frame member is connected to the upper support member proximate the sealing member, and a second end of the first frame member is connected to the lower support member for movement about a vertical axis. A brace member is connected to the first frame members and a second frame member. The second frame member has a first end adapted to be releasably connected to the upper support member such that the brace member is adapted to apply an upward force on the second frame member in order to maintain the second end of the second frame member in releasable connection with the upper support member. A panel is installed, extending from the sealing member past the first frame member to the second frame member.

DETAILED DESCRIPTION

This invention provides a low cost, light weight shower door assembly. The door is easily transported and installed by the consumer. Since the door is not necessarily permanently mounted in a shower enclosure, the purchaser has the advantage of being able to remove the door when moving, for example, and reinstall it. In addition, the shower door uses a removable fabric or vinyl water barrier. This means that one can purchase the fabric or vinyl in a variety of different colors or patterns in order to match a particular bathroom or shower enclosure. The fabric or vinyl is thus easily and inexpensively replaced without having to replace the entire shower door assembly.

Figure 1:
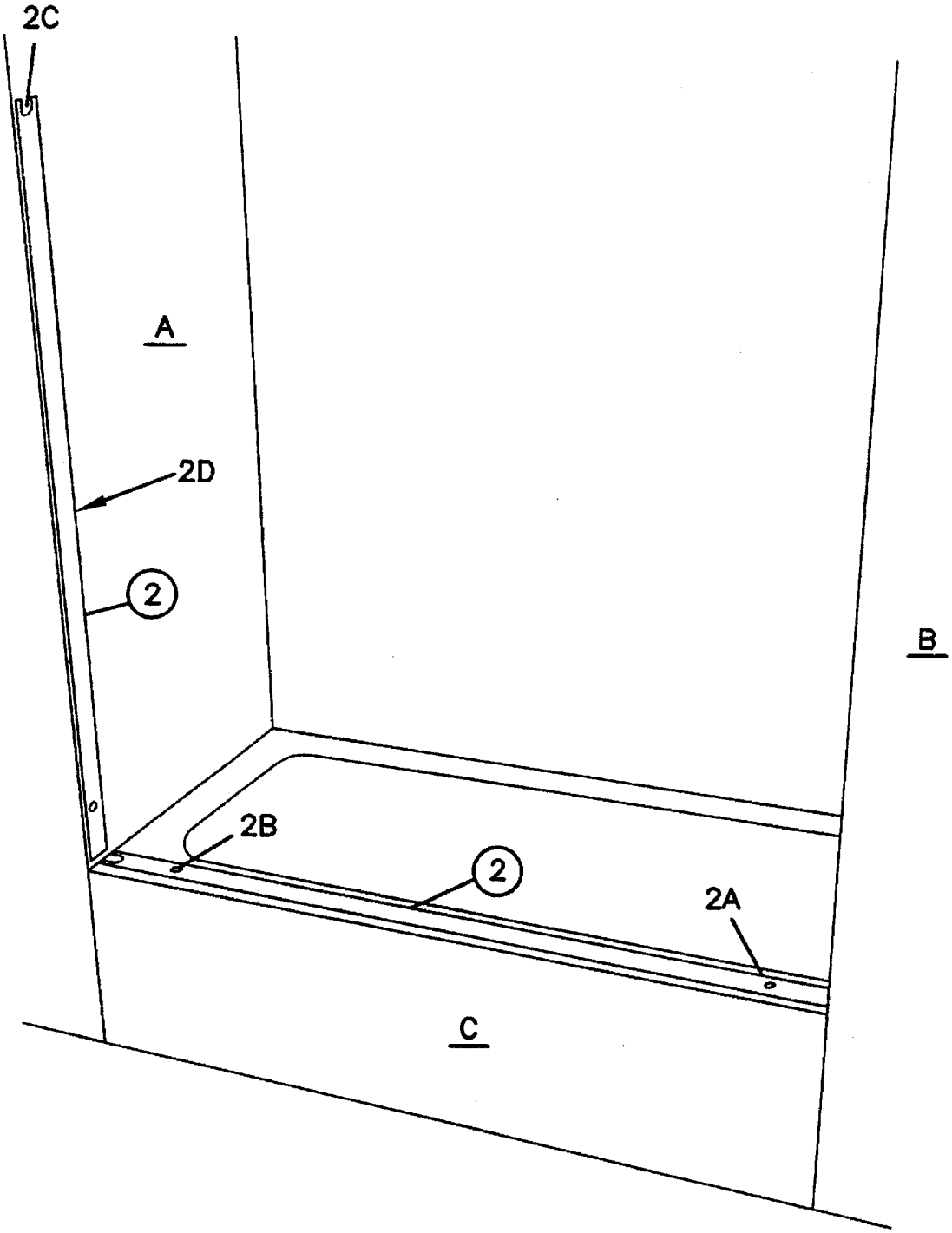
FIG. 1 is an example of a tub or shower enclosure into which is mounted a shower door assembly in accordance with the principles of the present invention.

FIG. 1 is an example of a tub or shower enclosure into which is mounted the shower door assembly. The enclosure typically includes opposing sides A and B, and a base C. The shower door assembly provides a water barrier at the opening defined by sides A and B, and base C. The shower enclosure may include a tub with base C being the tub ledge. The shower enclosure may also include simply a shower stall with the base C being at or approximately level with the floor. Other shower enclosures are possible for use with the present invention.

Figure 2:
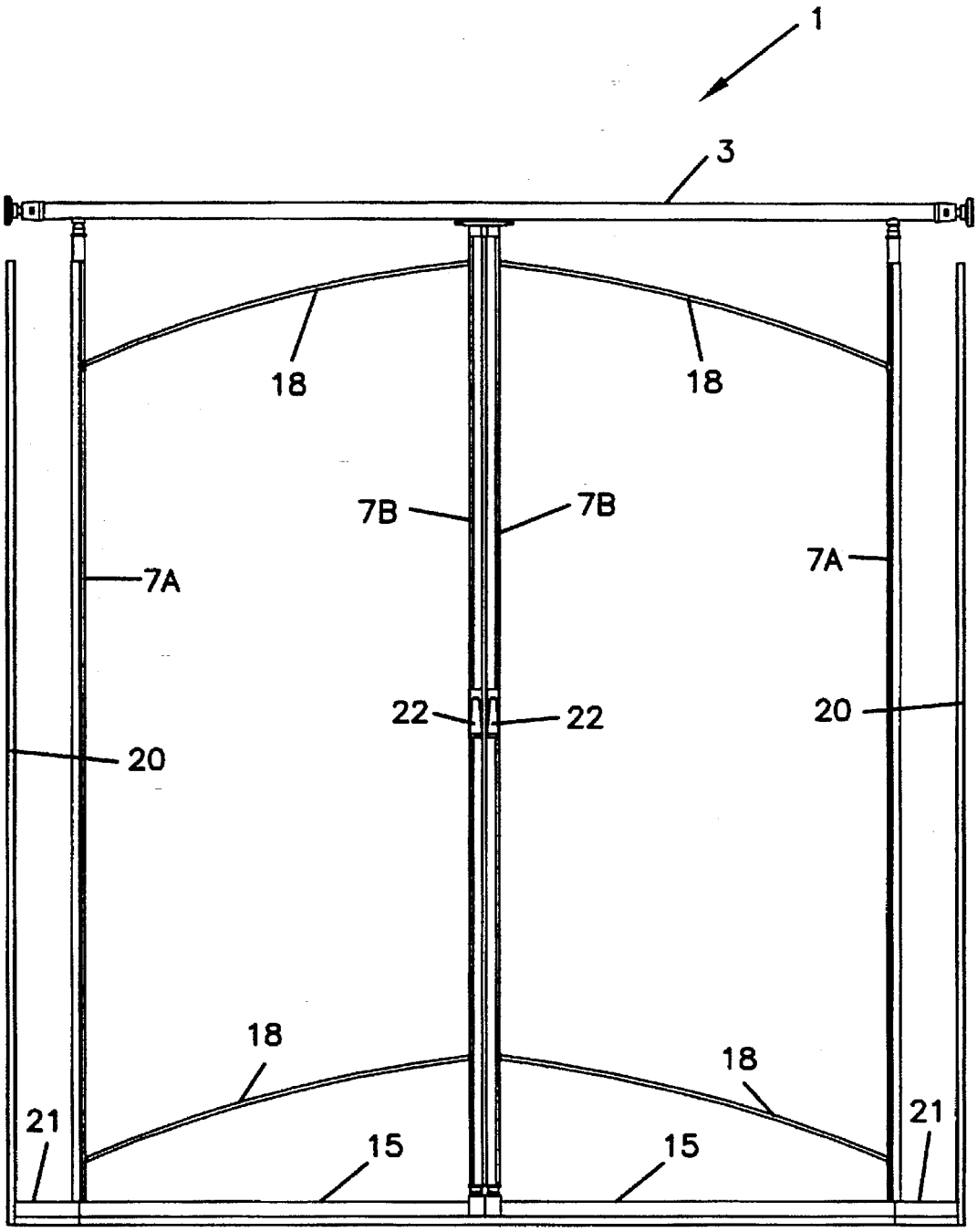
FIG. 2 is a face view of a shower door assembly in accordance with the principles of the present invention.
Figure 3:
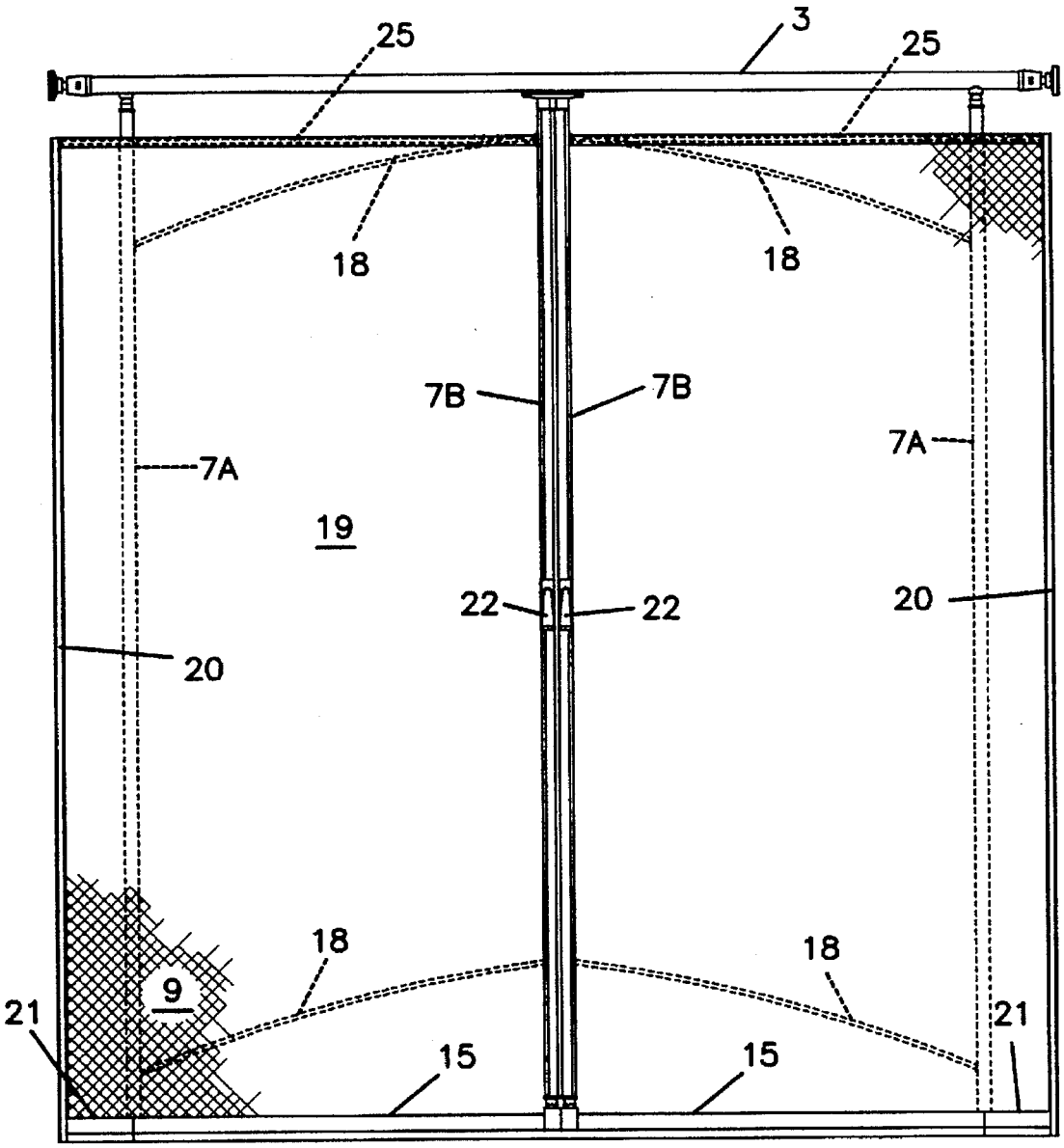
FIG. 3 is a face view of the shower door assembly with a fabric water barrier.

FIG. 2 is a face view of a shower door assembly 1 without the fabric water barrier. FIG. 3 is a face view of the fully installed shower door assembly 1 with the fabric 9. The following explains installation of the shower door assembly 1 with one door 19. The second door is assembled, installed, and operates in a similar manner as the first door 19.

Referring again to FIG. 1, there is a longitudinally extending cardboard template indicated by the numeral 2. This template has suitable transverse perforations appropriate for either a 54" or a 60" shower enclosure. Template 2 is folded along these perforations into a U-shape with the central horizontal portion positioned on the tub ledge and with the opposite vertical portions extending up shower walls A and B. Only shower wall A is shown in FIG. 7, but there would be a vertical extension of 2 oppositely disposed from that shown.

Figure 7:
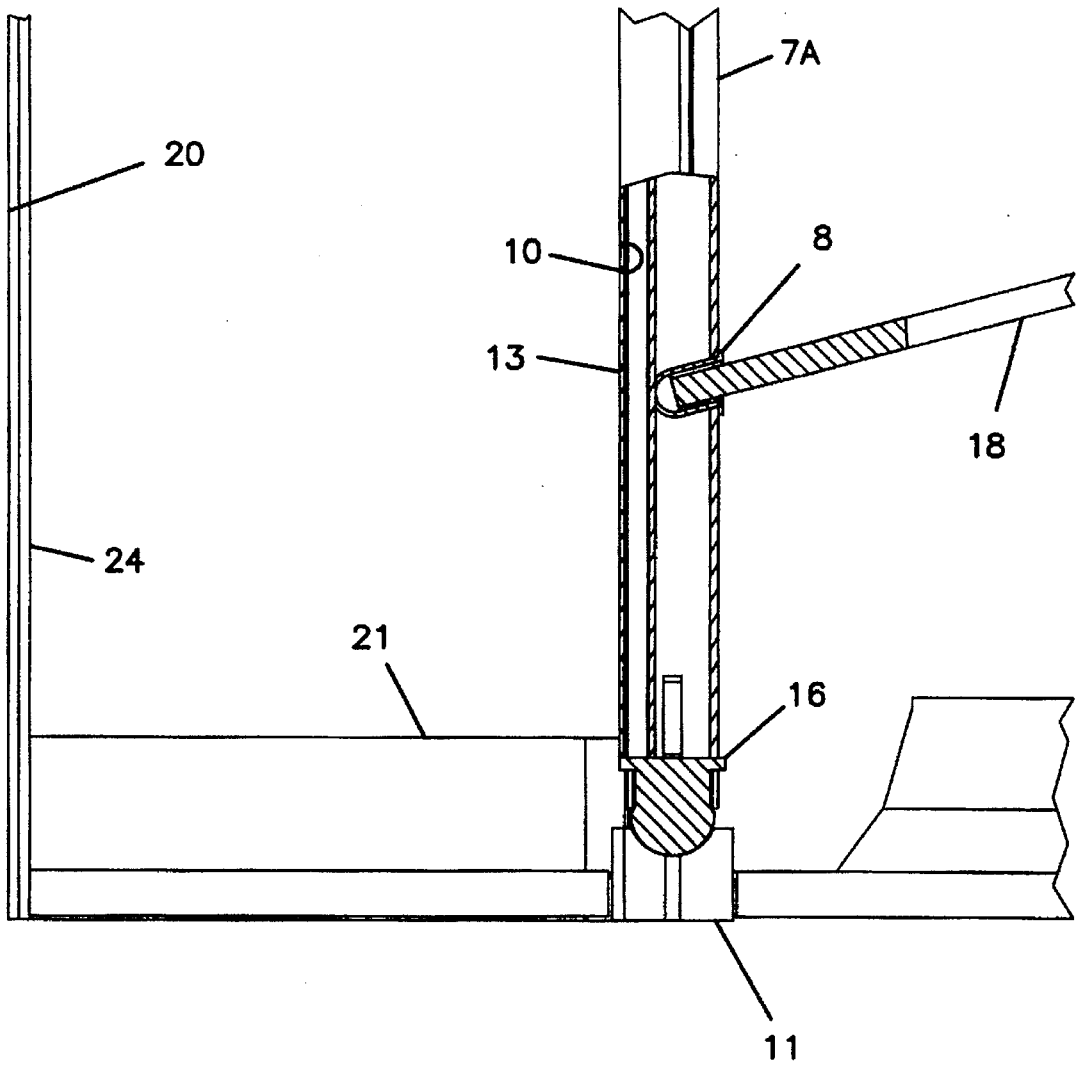
FIG. 7 is an enlarged face view of a lower left portion of the shower door assembly.
Figure 9:
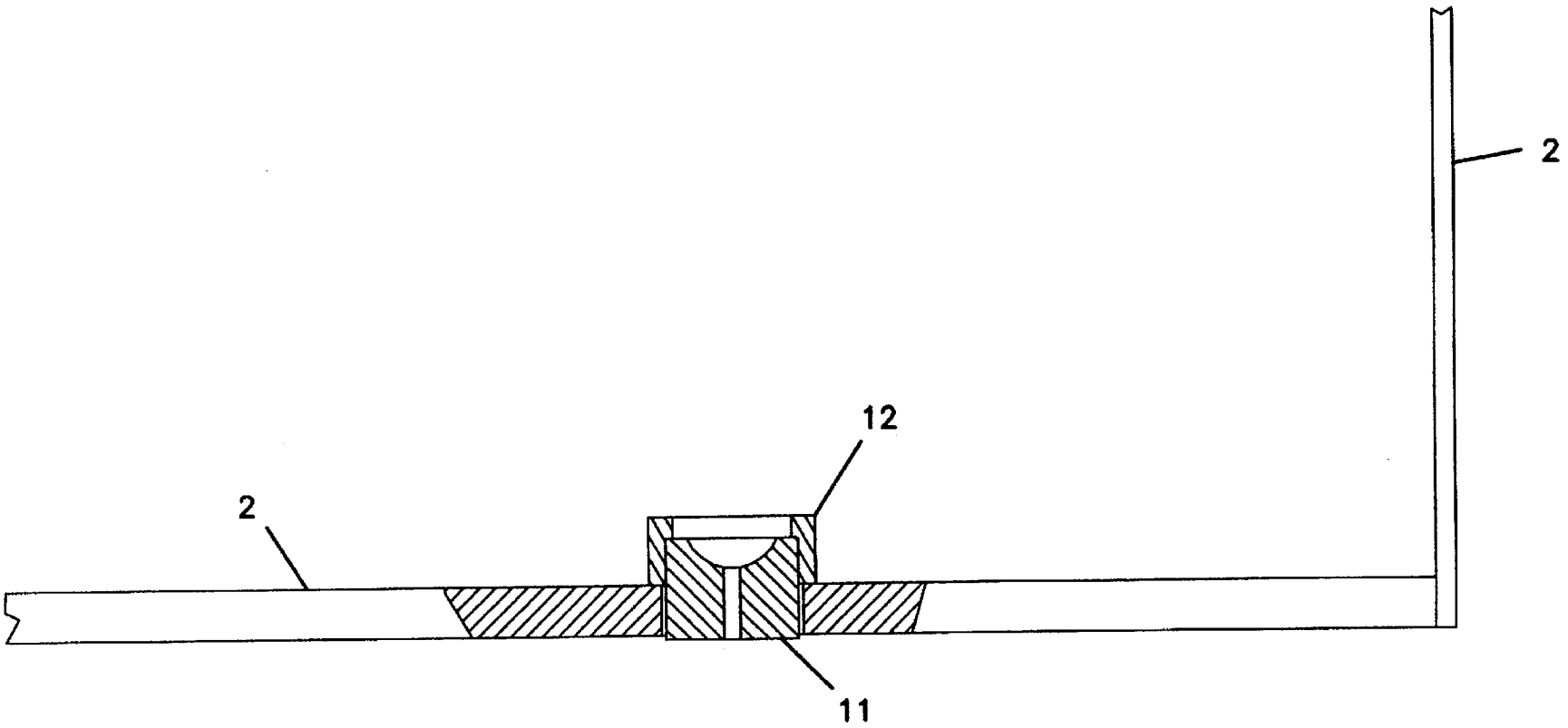
FIG. 9 is an enlarged face view of a lower right portion of the shower door assembly.

There are two generally cylindrical plastic parts, with external threads, designated by parts 11 in FIG. 2 (see FIGS. 7 and 9 for more detail of parts 11). Parts 11 have flat bottoms with suitable adhesive tape material to be used in anchoring parts 11 to the tub ledge as shown in FIGS. 2, 7 and 9. A paper backing from the flat bottom of parts 11 is removed and parts 11 are anchored to the tub ledge through the holes cut in template 2. These holes are indicated on FIG. 1 by the numerals 2A and 2B. There are two internally threaded plastic rings 12 which thread onto parts 11 to temporarily lock template 2 onto the tub ledge in the appropriate position (see FIG. 9). The upper end of the vertical extensions of template 2 each have a cut-out portion designated 2C which is used to appropriately position valance 3.

Figure 4:
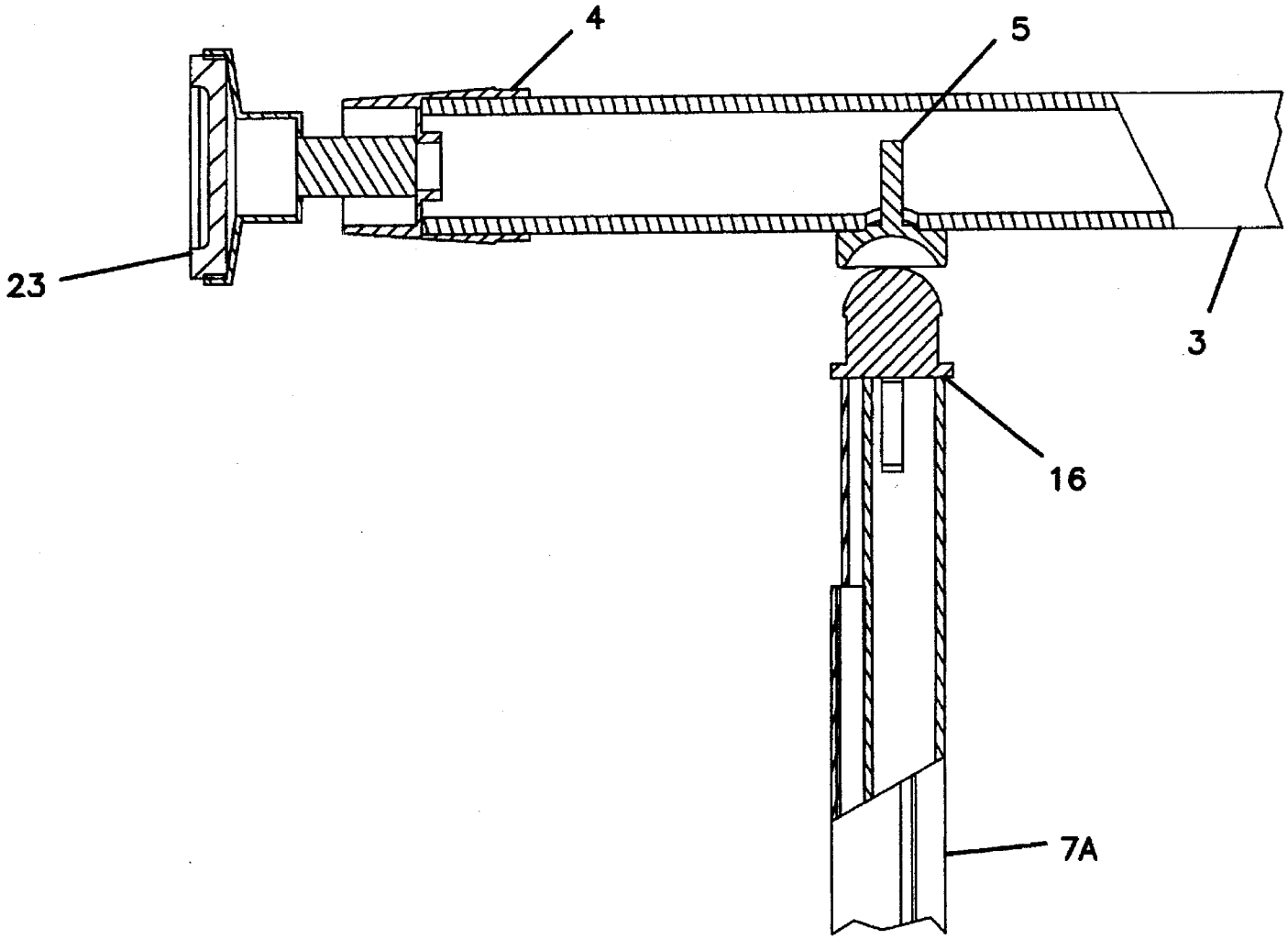
FIG. 4 is an enlarged face view of an upper left portion of the shower door assembly.
Figure 6:
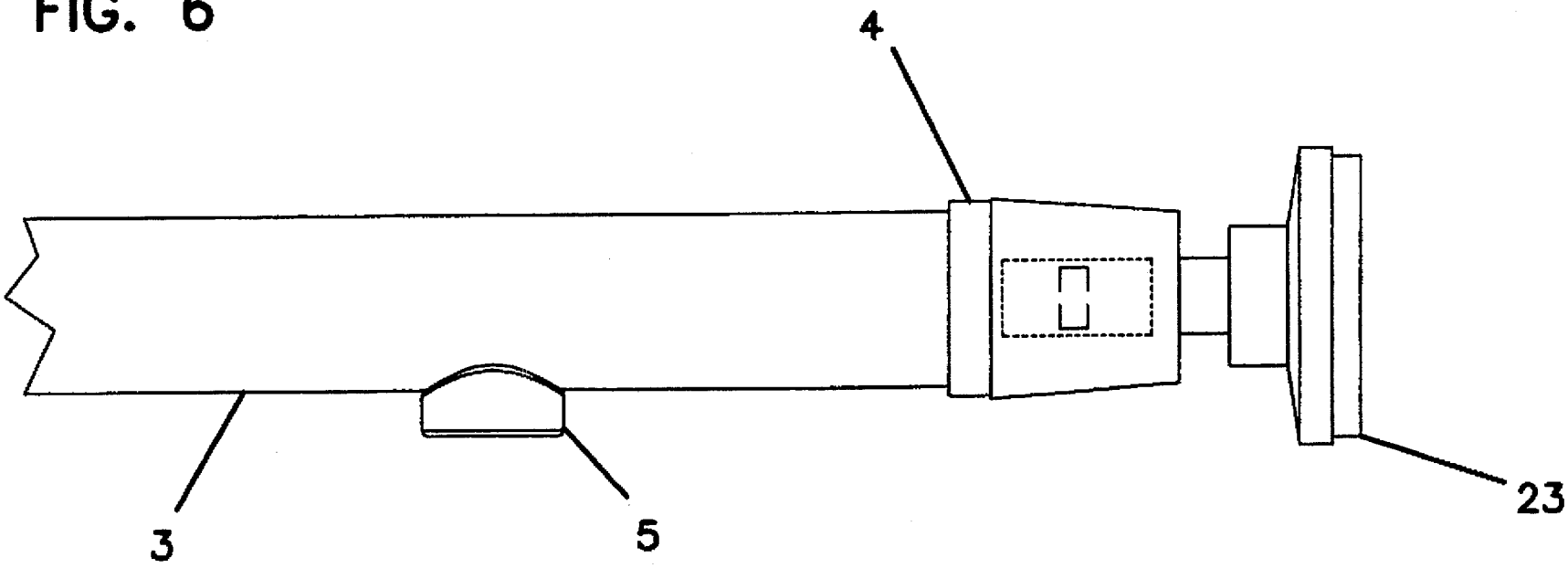
FIG. 6 is an enlarged face view of an upper right portion of the shower door assembly.

This sets the rough height of valance 3 (see FIGS. 4 and 6 for more detail of the attachment of valance 3 to sides A and B). The valance is also referred to as an upper support member and is preferably implemented with aluminum tubing. The plastic snaps of 5 and 6 are pushed into the holes of part 3. The telescoping sections 4 are turned in order to adjust the length of part 3 such that a light, snug fit exists between rubber pucks 23 and the shower enclosure walls A and B, thus securing valance 3. Items 20 (fabric wall snap) are aligned with the vertical edge of 2 towards the inside of the shower enclosure, marked 2D on FIG. 1, paper backings are peeled away from the tape on the flat bottom of items 20, and one is attached onto enclosure wall A and the other is attached onto enclosure wall B. Template 2 is then removed by unthreading the rings 12 from each of the anchor members 11. The anchor members 11 are also referred to as lower support members.

Referring particularly to FIGS. 7 and 9, dam members 21 should now be installed. The flat bottoms of 21 also have adhesive material and paper backing. The paper backing is removed. The right-hand end of member 21 has a hole which fits over cylindrical anchor 11 with the radius end of item 21 against the shower wall A. Referring to FIG. 2, it shows the valance 3 to be positioned against sides A and B, and also dams 21 and anchors 11 to be secured to the tub ledge or base C.

Figure 5:
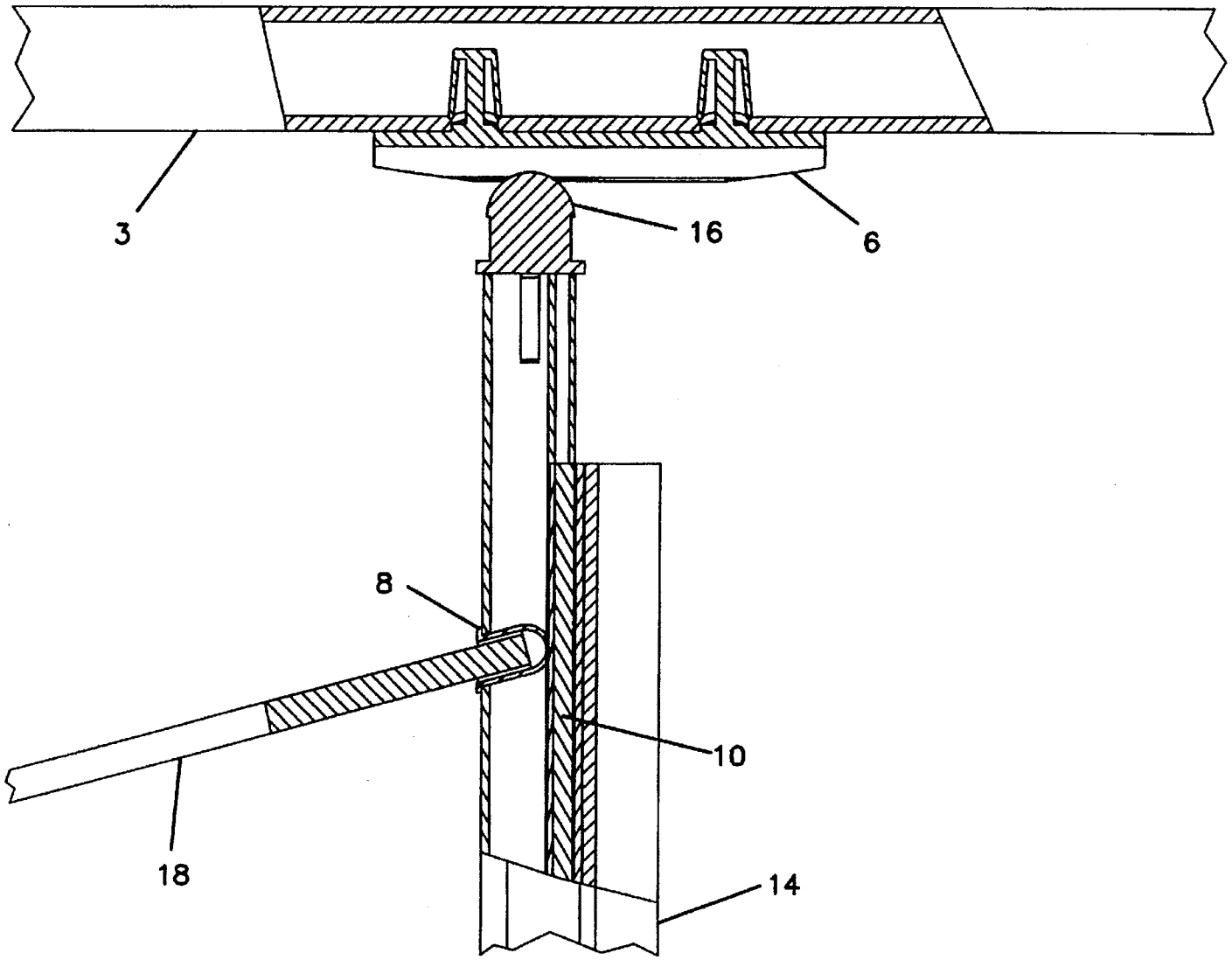
FIG. 5 is an enlarged face view of an upper middle portion of the shower door assembly.
Figure 8:
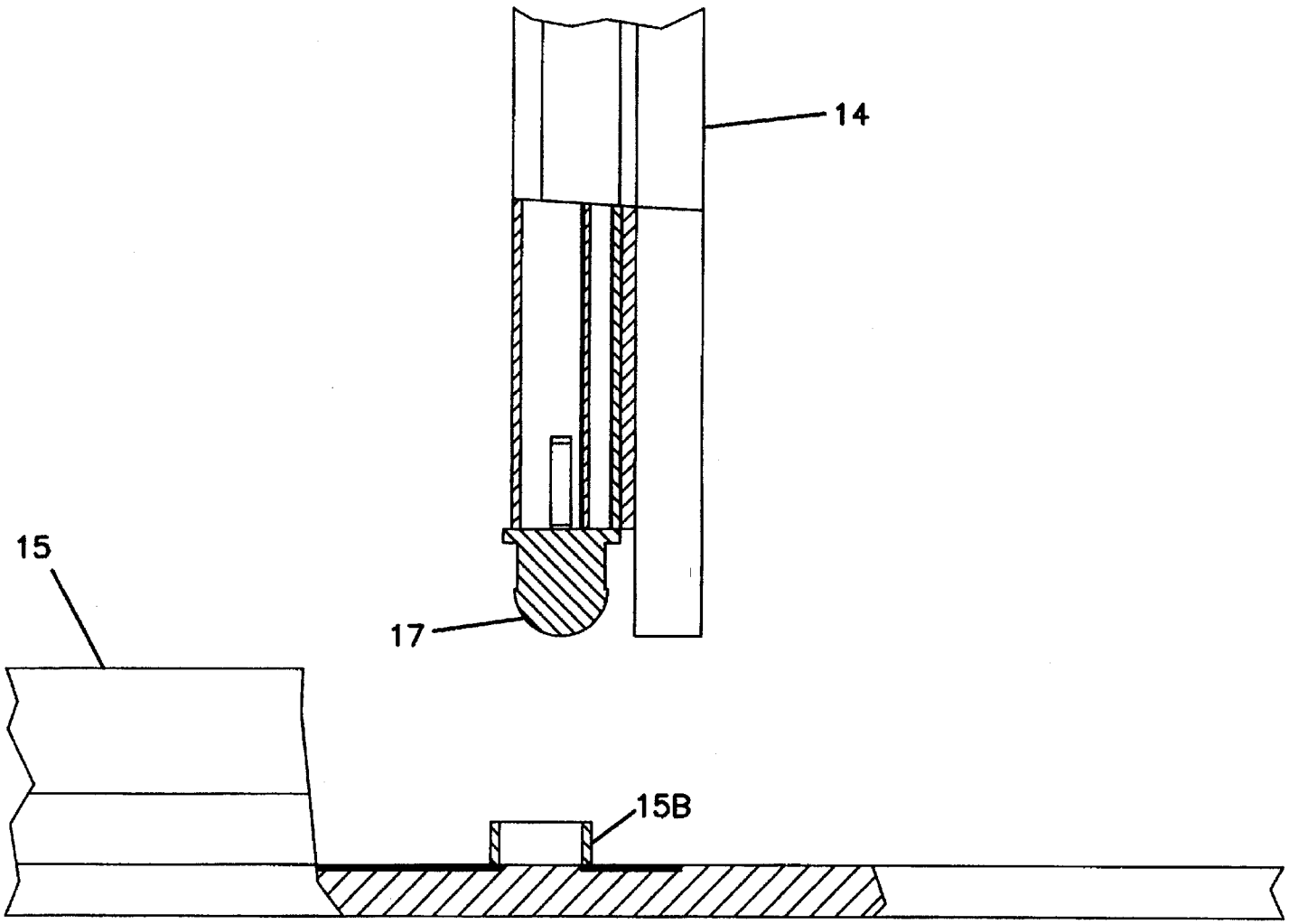
FIG. 8 is an enlarged face view of a lower middle portion of the shower door assembly.

Shower doors 19 are assembled as follows. End caps 16 and 17 are pushed into the door frame members 7A and 7B (see FIGS. 4 and 8). The frame members 7A and 7B are preferably implemented with aluminum tubing. Flexible rod mounts 8 are pushed into the holes of frame members 7A and 7B. The ends of flexible rods 18 are placed into the flexible rod mounts 8 (see FIGS. 4, 5, and 7). When installed, the flexible rods 18, or base members, are bowed slightly in order to apply an upward force on frame member 7B. The required bend in the flexible rods 18 may be accomplished by proper orientation of the mounts 8 in the frame members 7A and 7B. The flexible rods 18 are preferable bowed a sufficient amount so that frame member 7B moves about 1.5 inches in the vertical direction from the open to closed positions.

Fabric 9, shown in FIG. 3, is unrolled and positioned with its hem at what will be the upper end of the door 19. The fabric 9 is typically implemented with vinyl such as that used in conventional shower curtains. A fabric stiffening rod 25 is slid into this hem (see FIG. 3). Starting at the mating surface of 17, edge frame seal 10 is pushed into the longitudinally extending channel of door frame member 7B and the inwardly spaced frame seal 10 is pushed into the longitudinally extending channel of frame member 7A. The fabric has a flat and clean appearance. Grabbing the ends of member 15 (base or tub ledge seal), the donut-shaped ends are lightly stretched into the grooves of end caps 16 and 17.

After the door 19 is assembled, it can be put into position. Upper end cap 16 of door frame member 7A is mated into T-shaped socket joint 5, or connector bracket, (see FIG. 4) and the lower end cap 16 of frame member 7A is mated into part 11 or lower socket joint (see FIG. 7). The length of valance 3 may need to be adjusted slightly by turning telescoping ends 4. The door 19 is closed by pulling down on door frame member 7B and setting the hard end cap 16, which is at the upper end of door frame member 7B, into door closure detent 6 (see FIG. 5). With the door 19 closed, the longitudinal position of upper socket joint 5 is adjusted slightly by the valance telescoping ends 4. Part 13 (fabric seal guard) is pushed over door frame member 7A and part 14 (door to door seal or flange) is pushed over door frame member 7B. The bottom edge of 14 should be flush with the tub ledge. The left-hand extrusion 24 (fabric to wall seal) should be pushed into the longitudinally extending channel in wall fabric connector member 20.

When the door 19 is installed, the fabric 9 includes three seals. A first seal is formed by part 24, which is within the fabric 9, being held into part 20 (see FIG. 4). A second seal is formed by inwardly spaced frame seal 10 and fabric seal guard (see FIG. 7). As seen in FIGS. 3 and 7, the fabric 9 connected between the first and second seals form a side panel between frame member 7A an a side of the enclosure. A third seal is formed by edge frame seal 10 and frame member 7B (see FIG. 5). At the bottom of the shower door assembly 1, the dam members 21 and parts 15 (base or tub ledge seal) help prevent water from escaping between the bottom of the fabric 9 and the base C of the shower enclosure.

Figure 11:
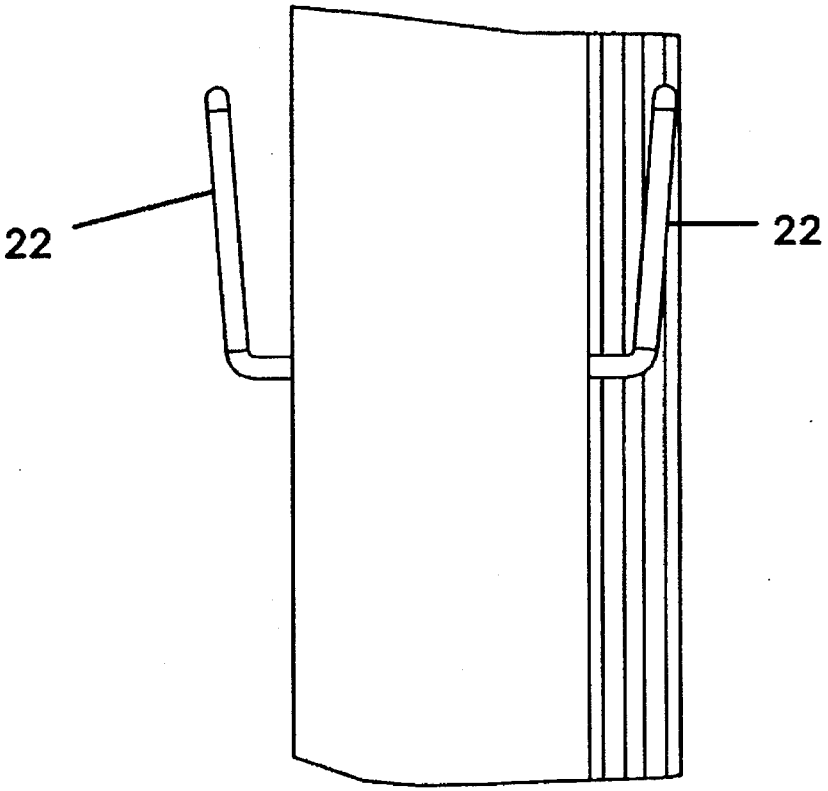
FIG. 11 is a side view of the handle, showing both a first handle on the inside and a second handle on the outside of the shower door assembly.
Figure 10:
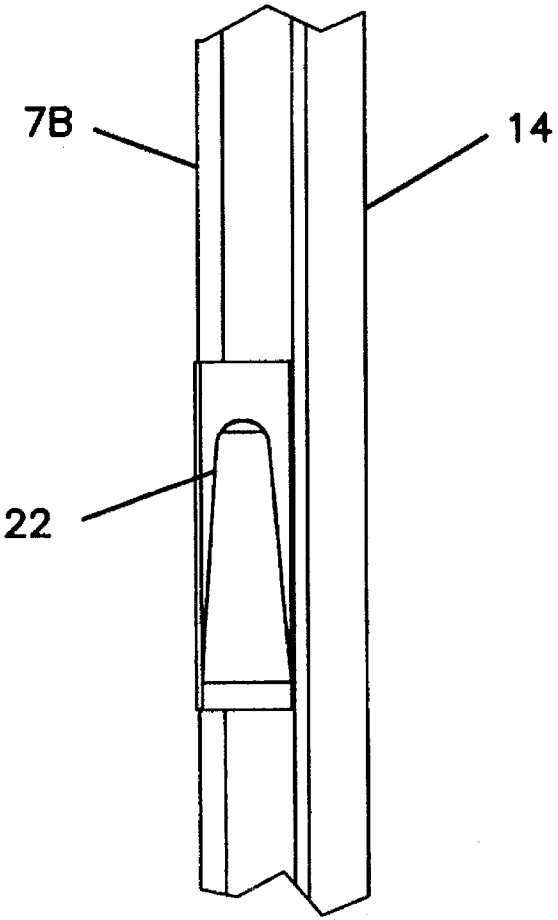
FIG. 10 is an enlarged face view of a handle for the shower door assembly.

Referring to FIGS. 10 and 11, the door 19 also includes handles 22 on both inside and outside sides of the door 19. A backing from the adhesive tape on the cylindrical surface of handle 22 is removed. The handles 22 are then attached onto the approximate midpoint of 14 on both sides.

The handles are attached to the doors with the open end facing up in order to assist a person in opening the doors. In order to open the doors, such as door 19, one grasps the handle 22 and pulls downward slightly to release the frame member 7B from the detent 6. The soft part 15B (see FIG. 8) allows one to move 7B downward when the door 19 is in the closed position. The door 19 can then be swung outward by rotation of frame member 7A about a vertical axis. The slight bend in flexible rods 18 thus allows one to easily open the door 19 by moving frame member 7B downward and also holds the door 19 in a closed position by applying an upward force on frame member 7B to hold it in contact with detent 6.

Figure 12:
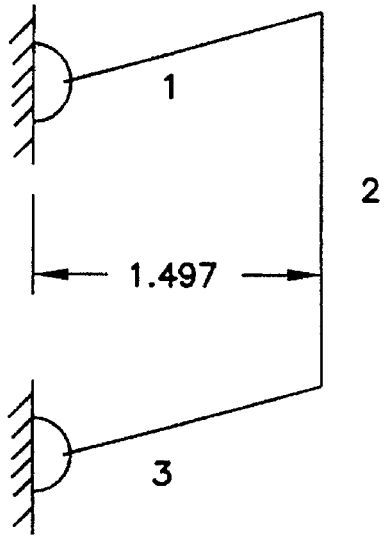
FIGS. 12–14 are linkage diagrams illustrating the use of a fabric door for the shower door assembly.
Figure 13:
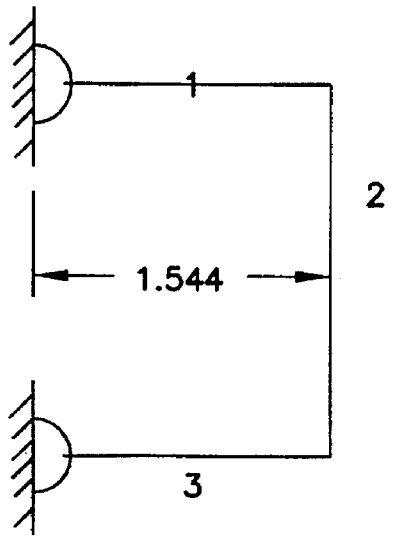
Figure 14:
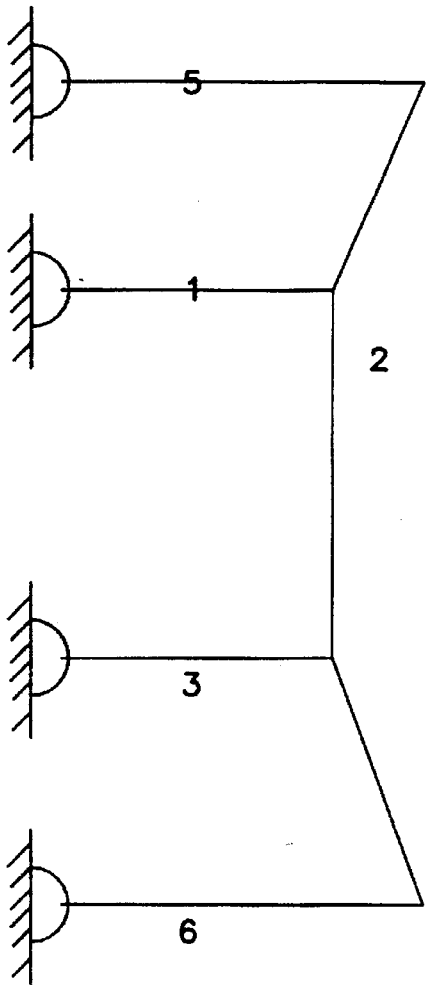

Referring to FIGS. 12–14, the following explains how the incline of flexible rods 18 aids in keeping the fabric 9 taut when the door 19 is in a closed position. As the common perpendicular distance between frame members 7A and 7B increases, the fabric becomes more taut. The shortest distance between two points is a straight line. Therefore, as flexible rods 18 unflex the distance between the endpoints of the flexible rods 18 increases.

The shower door assembly 1 can be modeled as a simple four bar linkage, as shown in FIGS. 12 and 13, ignoring the slight flexing of flexible rods 18. As demonstrated in FIGS. 12 and 13, the common perpendicular distance between frame members 7A and 7B increases. This distance increase more than makes up for the flexing of flexible rod 18 when closing the door 19 bringing 7A and 7B closer due the to the phenomenon described above. If flexible rods 18 were horizontal and bent, which they have to be in order for the door 19 to work, either the fabric 9 would have to be taut both open and closed or slack in the closed position. Having the fabric 9 taut when both open and closed effectively adds links 5 and 6, as shown in FIG. 14. This overconstrains the mechanism, i.e., it cannot move.

While the present invention has been described in connection with a preferred embodiment thereof, it will be understood that many modifications will be readily apparent to those skilled in the art, and this application is intended to cover any adaptations or variations thereof. It is manifestly intended that this invention be limited only by the claims and equivalents thereof.

What is claimed is:

1. A shower door assembly for enclosing a tub or shower enclosure having sides and a base, comprising:

an upper support member adapted to be positioned against opposing sides of the enclosure;

a lower support member adapted to be positioned against the base of the enclosure;

a frame, comprising first and second laterally spaced frame members, the first frame member having a first end connected to the upper support member and a second end connected to the lower support member for movement about a vertical axis, and a second frame member having a first end adapted to be releasably connected to the upper support member;

a panel extending between the first and second frame members: and a brace member connecting the first and second frame members, the brace member being adapted to apply an upward force on a second frame member in order to maintain the first end of the second frame member in releasable connection with the upper support member.

2. The shower door assembly of claim 1, further comprising a connector bracket connecting the first end of the first frame member to the upper support member.

3. The shower door assembly of claim 2 wherein the upper support member includes a telescoping portion for positioning of the upper support member against opposing sides of the enclosure.

4. The shower door assembly of claim 1, further comprising a side panel connected to the first frame member and adapted to be positioned against one of the sides of the enclosure.

5. The shower door assembly of claim 4 wherein the side panel comprises a fabric material.

6. The shower door assembly of claim 1, further comprising:

a sealing member adapted to be positioned against one of the sidewalls and proximate the first frame member; wherein the panel extends from the sealing member past the first frame member to the second frame member.

7. The shower door assembly of claim 1, further comprising a handle connected to the second frame member.

8. The shower door assembly of claim 1 wherein the brace member comprises a pair of laterally spaced flexible rods each having a first end connected to the first frame member and a second end connected to the second frame member, and each being bowed in order to apply the upward force on the second frame member.

9. The shower door assembly of claim 1, further comprising a detent connected to the upper support member, and wherein the first end of the second support member is releasably connected to the detent.

10. The shower door assembly of claim 9, further comprising a rounded end cap connected to the first end of the second support member.

11. The shower door assembly of claim 1, further comprising a pair of rubber end caps connected to opposing ends of the upper support member to be positioned against the opposing sides of the enclosure.

12. A shower door assembly for enclosing a tub or shower enclosure having first and second opposing sides and a base, comprising:

an upper support member adapted to be positioned against opposing sides of the enclosure;

a lower support member adapted to be positioned against the base of the enclosure and comprising a compressible material;

a first sealing member adapted to be positioned against the first side of the enclosure;

a second sealing member adapted to be positioned against the second side of the enclosure;

a first frame, comprising first and second laterally spaced frame members, the first frame member to be positioned proximate the first sealing member and having a first end connected to the upper support member and a second end connected to the lower support member for movement about a vertical axis, and the second frame member having a first end adapted to be releasably connected to the upper support member and having a second end releasably positioned on the lower support member, wherein the compressible material allows for vertical movement of the second frame member;

a second frame, comprising third and fourth laterally spaced frame members, the third frame member to be positioned proximate the second sealing member and having a first end connected to the upper support member and a second end connected to the lower support member for movement about a vertical axis, and the fourth frame member having a first end adapted to be releasably connected to the upper support member proximate the second support member and having a second end releasably positioned on the lower support member, wherein the compressible material allows for vertical movement of the fourth frame member;

a flange adapted to be connected to the second frame member or the fourth frame member;

a first panel extending from the first sealing member past the first frame member to the second frame member;

a second panel extending from the second sealing member past the third frame member to the fourth frame member;

a first brace member connecting the first and second frame members, the first brace member being adapted to apply an upward force on the second frame member in order to maintain the first end of the second frame member in releasable connection with the upper support member; and a second brace member connecting the third and fourth frame members, the second brace member being adapted to apply an upward force on the fourth frame member in order to maintain the first end of the fourth frame member in releasable connection with the upper support member.

13. The shower door assembly of claim 12, further comprising a first handle connected to the second frame member and a second handle connected to the fourth frame member.

14. The shower door assembly of claim 12, further comprising a detent connected to the upper support member, wherein the first end of the second support member and the first end of the fourth support member are each releasably connected to the detent.

15. The shower door assembly of claim 12, further comprising a first connector bracket connecting the first end of the first frame member to the upper support member; and a second connector bracket connecting the first end of the second frame member to the upper support member.

16. The show door assembly of claim 15 wherein the upper support member includes a pair of telescoping portions for positioning of the upper support member against opposing sides of the enclosure.

17. A shower door assembly for enclosing a tub or shower enclosure having sides and a base, comprising:

an upper support member adapted to be positioned against opposing sides of the enclosure;

a lower support member adapted to be positioned against the base of the enclosure;

a frame, comprising first and second laterally spaced frame members, the first frame member having a first end connected to the upper support member and a second end connected to the lower support member for movement about a vertical axis, and a second frame member having a first end adapted to be releasably connected to the upper support member;

a brace member connecting the first and second frame members;

a panel extending between the first and second frame members;

a connector bracket connecting the first end of the first frame member to the upper support member; and wherein the upper support member includes a telescoping portion for positioning of the upper support member against opposing sides of the enclosure.

18. A method of installing a shower door assembly for enclosing a tub or shower enclosure having sides and a base, comprising the steps of:

installing an upper support member positioned against opposing sides of the enclosure;

installing a lower support member positioned against the base of the enclosure;

installing a sealing member against one of the sides of the enclosure;

connecting a first end of a first frame member to the upper support member proximate the sealing member, and connecting a second end of the first frame member to the lower support member for movement about a vertical axis;

connecting a brace member to the first frame members;

connecting a second frame member to the brace member, the second frame member having a first end adapted to be releasably connected to the upper support member, and wherein the brace member is adapted to apply an upward force on the second frame member in order to maintain the first end of the second frame member in releasable connection with the upper support member; and installing a panel extending from the sealing member past the first frame member to the second frame member.

* * * * *